US007654822B2

(12) United States Patent
Soller et al.

(10) Patent No.: US 7,654,822 B2
(45) Date of Patent: Feb. 2, 2010

(54) CANDLE ASSEMBLY INCLUDING A FUEL ELEMENT WITH A LOCATING RECESS AND A MELTING PLATE WITH A LOCATING PROTRUSION

(75) Inventors: Douglas A. Soller, Racine, WI (US); Nathan R. Westphal, Union Grove, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 379 days.

(21) Appl. No.: 11/182,689

(22) Filed: Jul. 15, 2005

(65) Prior Publication Data

US 2007/0015096 A1 Jan. 18, 2007

(51) Int. Cl.
*F23D 3/16* (2006.01)

(52) U.S. Cl. ..... 431/289; 431/291; 431/292; 431/294; 44/275; 44/519

(58) Field of Classification Search ..... 431/289, 431/253, 291, 292, 126, 288, 294, 295, 296, 431/297; D26/9; 44/275, 519
See application file for complete search history.

(56) References Cited

U.S. PATENT DOCUMENTS

| | | | |
|---|---|---|---|
| 213,184 | A | 3/1879 | Frick |
| 405,786 | A | 6/1889 | Ludde |
| 407,051 | A | 7/1889 | Baumer |
| 408,973 | A | 8/1889 | Heller |
| 484,210 | A | 10/1892 | Ludde |
| 779,644 | A | 1/1905 | Ferrier |
| 837,240 | A | 11/1906 | Mulkerins |
| 1,044,256 | A | 11/1912 | Satter |
| D43,845 | S | 4/1913 | Hirschfeld |
| 1,195,657 | A | 8/1916 | Chersky |
| D49,902 | S | 11/1916 | Labaree et al. |
| 1,226,850 | A | 5/1917 | Booty |
| 1,229,140 | A | 6/1917 | Ritter |
| 1,309,545 | A | 7/1919 | Reicher |
| 1,316,624 | A | 9/1919 | Lucas |
| 1,320,109 | A | 10/1919 | Wooster |
| 1,336,635 | A | 4/1920 | Knapp |

(Continued)

FOREIGN PATENT DOCUMENTS

| | | |
|---|---|---|
| CA | 2208145 | 12/1998 |

(Continued)

OTHER PUBLICATIONS

International Candle House catalog (1966-67); Bobeshes pp. 54-55.

(Continued)

*Primary Examiner*—Steven B McAllister
*Assistant Examiner*—Avinash Savani

(57) ABSTRACT

A melting plate candle assembly includes a melting plate with a locating protrusion, which engages a fuel element in a predefined orientation when in a preferred operative position. In one operative position, the bottom surface of the fuel element is disposed on the melting plate, and a capillary space is formed between a capillary pedestal on the melting plate and a capillary recess in the bottom surface of the fuel element. The locating protrusion provides positive indication that the fuel element is properly disposed in the operative position.

15 Claims, 3 Drawing Sheets

U.S. PATENT DOCUMENTS

| | | | | |
|---|---|---|---|---|
| 1,344,446 | A | | 6/1920 | Engman |
| 1,390,389 | A | | 9/1921 | Rosenfeld |
| 1,484,964 | A | | 2/1924 | Benneville |
| D67,108 | S | | 4/1925 | Steeple |
| 1,640,734 | A | | 8/1927 | Smith |
| 1,660,760 | A | | 2/1928 | Murphy |
| D75,463 | S | | 6/1928 | Bach |
| D80,971 | S | | 4/1930 | Sakier |
| D83,100 | S | | 1/1931 | Gisolfi |
| 2,034,166 | A | * | 3/1936 | Will et al. ..... 362/161 |
| D110,902 | S | | 8/1938 | Loesch |
| D119,587 | S | | 3/1940 | Fuerst |
| 2,234,903 | A | | 3/1941 | Muench |
| 2,237,523 | A | | 4/1941 | Damon |
| 2,240,071 | A | | 4/1941 | Gisolfi |
| 2,246,346 | A | | 6/1941 | Wells |
| 2,254,906 | A | | 9/1941 | Petrulis |
| 2,324,753 | A | | 7/1943 | Alexiade |
| 2,354,343 | A | | 7/1944 | Webber et al. |
| 2,393,767 | A | * | 1/1946 | Gould ..... 431/289 |
| 2,462,440 | A | | 2/1949 | Tierney |
| 2,494,995 | A | | 1/1950 | Gardner |
| 2,713,256 | A | | 7/1955 | Oesterle |
| 2,758,460 | A | | 8/1956 | Ciano |
| 2,775,006 | A | | 12/1956 | Kranc |
| 2,809,512 | A | | 10/1957 | Hartnett |
| RE24,423 | E | | 2/1958 | Oesterle et al. |
| 3,121,316 | A | | 2/1964 | Wilson |
| D206,946 | S | | 2/1967 | Knodt |
| D208,064 | S | | 7/1967 | Quistgaard et al. |
| D208,097 | S | | 7/1967 | Henn |
| 3,565,281 | A | | 2/1971 | Collie |
| D226,240 | S | | 1/1973 | Twedt |
| 3,730,674 | A | | 5/1973 | Gross |
| 3,741,711 | A | | 6/1973 | Bryant |
| 3,749,904 | A | | 7/1973 | Graff |
| 3,762,857 | A | | 10/1973 | Andeweg |
| D229,852 | S | | 1/1974 | Lindblad |
| D236,064 | S | | 7/1975 | Balbo |
| 3,898,039 | A | | 8/1975 | Lin |
| 3,910,753 | A | | 10/1975 | Lee |
| 3,932,113 | A | | 1/1976 | Thrush |
| 3,994,502 | A | | 11/1976 | Lombardi |
| 4,013,397 | A | | 3/1977 | Neugart |
| 4,019,856 | A | | 4/1977 | Lacroix |
| D247,635 | S | | 3/1978 | Maxwell |
| D248,499 | S | | 7/1978 | Ulrich et al. |
| D248,500 | S | | 7/1978 | Ulrich et al. |
| 4,102,634 | A | | 7/1978 | Crisp |
| D248,787 | S | | 8/1978 | Ulrich et al. |
| D248,788 | S | | 8/1978 | Ulrich et al. |
| D248,789 | S | | 8/1978 | Ulrich et al. |
| 4,134,718 | A | | 1/1979 | Kayfetz et al. |
| D253,432 | S | | 11/1979 | Van Koert |
| D253,732 | S | | 12/1979 | Van Koert |
| 4,185,953 | A | | 1/1980 | Schirneker |
| 4,206,500 | A | | 6/1980 | Neil |
| 4,206,560 | A | | 6/1980 | Sefried, II |
| 4,224,017 | A | | 9/1980 | Kayne |
| D264,385 | S | | 5/1982 | Meyer |
| 4,332,548 | A | | 6/1982 | Linton et al. |
| 4,381,914 | A | | 5/1983 | Ferguson |
| 4,427,366 | A | | 1/1984 | Moore |
| 4,477,249 | A | | 10/1984 | Ruzek et al. |
| 4,524,408 | A | | 6/1985 | Minera |
| 4,551,794 | A | | 11/1985 | Sandell |
| 4,557,687 | A | | 12/1985 | Schirneker |
| 4,568,269 | A | | 2/1986 | Lin |
| 4,568,270 | A | | 2/1986 | Marcus et al. |
| 4,588,618 | A | | 5/1986 | Wolfe |
| D292,525 | S | | 10/1987 | Van Deelen |
| 4,755,135 | A | | 7/1988 | Kwok |
| 4,781,895 | A | | 11/1988 | Spector |
| 4,804,323 | A | | 2/1989 | Kim |
| 4,887,960 | A | | 12/1989 | Stewart et al. |
| D312,507 | S | | 11/1990 | Thoreson |
| 4,983,119 | A | | 1/1991 | Lin |
| 5,015,175 | A | | 5/1991 | Lee |
| D320,266 | S | | 9/1991 | Kunze |
| 5,069,617 | A | | 12/1991 | Lin |
| 5,078,591 | A | | 1/1992 | Despres |
| 5,078,945 | A | | 1/1992 | Byron |
| 5,086,380 | A | | 2/1992 | Hedner, Jr. |
| D325,077 | S | | 3/1992 | Kearnes |
| 5,101,328 | A | | 3/1992 | Hai |
| 5,174,645 | A | | 12/1992 | Chung |
| 5,193,994 | A | | 3/1993 | Schirneker |
| 5,338,187 | A | | 8/1994 | Elharar |
| 5,363,590 | A | | 11/1994 | Lee |
| D355,266 | S | | 2/1995 | Caplette et al. |
| D356,472 | S | | 3/1995 | Jaworski |
| 5,425,633 | A | | 6/1995 | Cole |
| D360,461 | S | | 7/1995 | Gillespie |
| D369,871 | S | | 5/1996 | Lui |
| D371,212 | S | | 6/1996 | Hardy et al. |
| D376,002 | S | | 11/1996 | Upson |
| D377,402 | S | | 1/1997 | Perkins |
| D383,944 | S | | 9/1997 | Lillelund et al. |
| 5,690,484 | A | | 11/1997 | Leonard et al. |
| D390,676 | S | | 2/1998 | Hollington |
| D391,119 | S | | 2/1998 | Rapaz |
| D393,910 | S | | 4/1998 | Chambers et al. |
| D394,513 | S | | 5/1998 | Davis |
| 5,797,739 | A | | 8/1998 | Lioi |
| 5,807,096 | A | | 9/1998 | Shin et al. |
| D399,298 | S | | 10/1998 | Whitehead |
| 5,840,246 | A | | 11/1998 | Hammons et al. |
| 5,842,850 | A | | 12/1998 | Pappas |
| 5,843,194 | A | | 12/1998 | Spaulding |
| 5,871,553 | A | | 2/1999 | Spaulding |
| D410,756 | S | | 6/1999 | Kleinberg |
| 5,921,767 | A | | 7/1999 | Song |
| 5,927,959 | A | | 7/1999 | Johnson |
| 5,939,005 | A | | 8/1999 | Materna |
| 5,951,278 | A | | 9/1999 | Young et al. |
| 5,955,034 | A | | 9/1999 | Zaunbrecher et al. |
| 5,955,958 | A | | 9/1999 | Lu |
| 5,961,967 | A | | 10/1999 | Powell et al. |
| D416,099 | S | | 11/1999 | Hardy |
| D416,341 | S | | 11/1999 | Allen |
| 5,980,241 | A | | 11/1999 | Schirneker |
| 6,019,804 | A | | 2/2000 | Requejo et al. |
| 6,033,209 | A | * | 3/2000 | Shin et al. ..... 431/253 |
| D422,180 | S | | 4/2000 | Sundberg |
| 6,050,812 | A | | 4/2000 | Chuang |
| D425,220 | S | | 5/2000 | Klett et al. |
| D425,636 | S | | 5/2000 | Freeman |
| 6,059,564 | A | | 5/2000 | Morris |
| 6,062,847 | A | | 5/2000 | Pappas |
| 6,068,472 | A | | 5/2000 | Freeman et al. |
| D426,902 | S | | 6/2000 | Hardy et al. |
| 6,074,199 | A | | 6/2000 | Song |
| 6,079,975 | A | | 6/2000 | Conover |
| 6,099,877 | A | | 8/2000 | Schuppan |
| D430,943 | S | | 9/2000 | Zutler |
| D433,168 | S | | 10/2000 | Cousins |
| 6,129,771 | A | | 10/2000 | Ficke et al. |
| 6,152,728 | A | | 11/2000 | Griffel |
| D435,100 | S | | 12/2000 | Pesu et al. |
| D436,415 | S | | 1/2001 | Hardy |
| 6,214,063 | B1 | | 4/2001 | DeStefano et al. |
| D443,080 | S | | 5/2001 | Klett et al. |
| D443,081 | S | | 5/2001 | Klett et al. |
| D443,082 | S | | 5/2001 | Klett et al. |

D443,101 S 5/2001 Williamson
6,231,336 B1 5/2001 Chen
6,241,362 B1 6/2001 Morrison
6,241,513 B1 6/2001 Jeneral
D445,030 S 7/2001 Croft et al.
D445,337 S 7/2001 Croft et al.
6,267,584 B1 7/2001 Zou
6,270,339 B1 8/2001 Zou
6,273,710 B1 8/2001 Zou
6,276,925 B1 8/2001 Varga
D447,418 S 9/2001 Bezek et al.
6,290,489 B1 9/2001 Seidler
D448,867 S 10/2001 Manocheo et al.
6,296,477 B1 10/2001 Lin
6,299,435 B1 10/2001 Freeman et al.
D450,395 S 11/2001 Bellenger
D450,865 S 11/2001 Bellenger et al.
6,328,935 B1 12/2001 Buccellato
6,361,311 B1 3/2002 Smith
D455,486 S 4/2002 Makino
D455,846 S 4/2002 Araujo
D456,539 S 4/2002 Leeds
6,371,756 B1 4/2002 Toohey
D459,498 S 6/2002 Araujo
6,398,544 B2 6/2002 Wright et al.
D461,916 S 8/2002 Araujo
D462,132 S 8/2002 Papai
6,428,311 B1 8/2002 Bernardo
6,439,471 B2 8/2002 Ehrlich et al.
D462,793 S 9/2002 Freeman et al.
6,450,802 B1 9/2002 Steck
6,454,561 B1 9/2002 Colthar et al.
D464,745 S 10/2002 Mangini et al.
6,468,071 B2 10/2002 Zoy
D465,587 S 11/2002 Papai
D466,236 S 11/2002 Papai
6,488,494 B2 12/2002 Lee
6,491,516 B1 12/2002 Tal et al.
D469,550 S 1/2003 Moeller
D469,893 S 2/2003 Shen
6,520,770 B2 2/2003 Zou
D471,299 S 3/2003 Papai
6,531,063 B1 3/2003 Rose
6,537,063 B1 3/2003 Pecoskie
6,543,268 B2 4/2003 Wright et al.
6,544,302 B2 4/2003 Berger et al.
6,551,365 B2 4/2003 Berger et al.
6,554,448 B2 4/2003 Carpenter et al.
D474,854 S 5/2003 Lam
6,568,934 B1 5/2003 Butler
6,575,613 B2 6/2003 Brown et al.
6,579,089 B1 6/2003 Iu
6,592,637 B2 7/2003 McGee et al.
6,595,771 B2 7/2003 Chu
6,616,308 B2 9/2003 Jensen et al.
D481,143 S 10/2003 McMinn
D481,473 S 10/2003 Walsh
6,630,110 B2 10/2003 Urfig
6,648,631 B2 11/2003 Wright et al.
D485,624 S 1/2004 Kitamura
6,688,880 B1 2/2004 Pangle
6,695,611 B2 2/2004 Lee
D487,687 S 3/2004 Shields, Jr.
6,709,266 B2 3/2004 Jensen
6,730,137 B2 5/2004 Pesu et al.
6,733,279 B2 5/2004 Thigpen et al.
D491,288 S 6/2004 Young
D493,548 S 7/2004 Goldman
D495,437 S 8/2004 Barbera
D495,438 S 8/2004 Barbera et al.
6,769,905 B2 8/2004 Gray et al.
6,780,382 B2 8/2004 Furner
D497,680 S 10/2004 McMinn
6,802,707 B2 10/2004 Furner
6,808,388 B2 10/2004 Lee
6,849,240 B2 2/2005 Nakatsu et al.
6,857,869 B1 2/2005 Sun
6,863,525 B2 3/2005 Byrd
6,923,639 B2 8/2005 Pesu et al.
7,247,017 B2 * 7/2007 Furner ..... 431/292
2001/0031438 A1 10/2001 Hannington et al.
2002/0066789 A1 6/2002 Yen
2002/0068009 A1 6/2002 Laudamiel-Pellet
2002/0068010 A1 6/2002 Laudamiel-Pellet
2002/0093834 A1 7/2002 Yu
2002/0102187 A1 8/2002 Bellenger et al.
2002/0119413 A1 8/2002 Cheng
2002/0127507 A1 9/2002 Long
2003/0027091 A1 2/2003 Brandt
2003/0064336 A1 4/2003 Welch
2003/0134246 A1 7/2003 Gray et al.
2003/0162142 A1 8/2003 Bennetts et al.
2003/0175148 A1 9/2003 Kvietok
2004/0007787 A1 1/2004 Kvietok
2004/0009103 A1 1/2004 Westring
2004/0009447 A1 1/2004 Decker
2004/0016818 A1 1/2004 Murdell
2004/0028551 A1 2/2004 Kvietok
2004/0029061 A1 2/2004 Dibnah et al.
2004/0033171 A1 2/2004 Kvietok
2004/0033463 A1 2/2004 Pesu et al.
2004/0128879 A1 7/2004 Lu
2004/0160764 A1 8/2004 Lee
2004/0223871 A1 11/2004 Woo
2004/0223943 A1 11/2004 Woo
2004/0229180 A1 11/2004 Furner
2004/0241053 A1 12/2004 Thompson
2004/0265164 A1 12/2004 Woo
2005/0019238 A1 1/2005 Hart et al.
2005/0037306 A1 2/2005 Nakatsu
2005/0079463 A1 4/2005 Yu
2005/0227190 A1 10/2005 Pappas
2006/0057521 A1 3/2006 Kubicek et al.
2006/0057522 A1 3/2006 Kubicek et al.
2006/0057523 A1 3/2006 Kubicek et al.
2006/0057526 A1 3/2006 Kubicek et al.
2006/0057528 A1 3/2006 Kubicek
2006/0057529 A1 3/2006 Kubicek et al.
2006/0084021 A1 * 4/2006 Kubicek ..... 431/291
2006/0183065 A1 8/2006 Konkle, Jr.

FOREIGN PATENT DOCUMENTS

DE 24 40 068 3/1976
DE 3302591 8/1984
DE 3403604 8/1985
DE 3918591 9/1990
DE 4203644 8/1993
DE 4241292 5/1994
DE 4314122 11/1994
DE 195 48 958 5/1996
DE 195 08 962 9/1996
DE 102004011919 6/2005
EP 0146247 6/1985
EP 1054054 11/2000
EP 1 336 799 8/2003
FR 256853 A1 * 2/1986
FR 2568583 A1 * 2/1986
FR 2628825 3/1988
GB 161342 4/1921
GB 1514338 6/1978
GB 2 239 942 7/1991
JP 362220594 9/1987
JP 406212189 8/1994
JP 408185710 7/1996
JP 2003-213292 7/2003

| | | |
|---|---|---|
| WO | WO 89/06141 | 7/1989 |
| WO | WO 95/12783 | 5/1995 |
| WO | WO 95/16876 | 6/1995 |
| WO | WO 96/02794 | 2/1996 |
| WO | WO 99/17055 | 4/1999 |
| WO | WO 99/45322 | 9/1999 |
| WO | WO 01/46618 | 6/2001 |
| WO | WO 2004/008026 | 1/2004 |
| WO | WO 2004/083349 | 9/2004 |
| WO | WO 2004/083718 | 9/2004 |
| WO | WO 2004/090417 | 10/2004 |

OTHER PUBLICATIONS

Pourette Catalog 1998; p. 12.
Prices London Candlemakers; http:www.prices-candles.co.uk/mainpage.htm; 1 page, printed Apr. 21, 2005.
Prices London Candlemakers; http:www.prices-candles.co.uk/catalogue/Accessories/Accessories%20Page%2008.jpg; 1 page; printed Apr. 21, 2005.
Two (2) photos of Price's "Coral Bay Fragranced Bathroom" product taken Jan. 1, 1999.
Stephanie Reiser Wrought Iron—"Welcome to CourtingCandle.com!" http://www/courtingcandle.com; 1 page printed on May 12, 2004.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,372, Office Action dated Feb. 27, 2007.
U.S. Appl. No. 11/124,313, Office Action dated Feb. 28, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
Intl. Search Report dated Oct. 13, 2006, Appl. No. PCT/US 2006/020218.
Intl. Search Report dated Jul. 27, 2006, Appl. No. PCT/US 2005/032266.
U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2005.
U.S. Appl. No. 10/938,434, Office Action dated Jul. 17, 2006.
U.S. Appl. No. 10/938,434, Final Office Action dated Nov. 20, 2006.
U.S. Appl. No. 10/978,744, Office Action dated Jul. 19, 2006.
U.S. Appl. No. 10/978,646, Office Action dated Aug. 3, 2006.
U.S. Appl. No. 10/978,744. Final Office Action dated Nov. 13, 2006.
PCT Intl. Search Report and Written Opinion dated Dec. 5, 2006, Appl. No. PCT/US2006/027556.
Office action dated May 4, 2007, U.S. Appl. No. 10/978,646.

* cited by examiner

CANDLE ASSEMBLY INCLUDING A FUEL ELEMENT WITH A LOCATING RECESS AND A MELTING PLATE WITH A LOCATING PROTRUSION

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to, candle assemblies, and more particularly to candle assemblies including a fuel element for placing on a support surface, such as a melting plate, for example.

2. Description of the Background of the Invention

Candle assemblies including a fuel element for placement on a support surface are adapted for many uses. One such candle assembly includes a candle holding socket in which four longitudinal engaging ribs protrude radially inwardly from a cylindrical peripheral wall and define a candle receiving space therebetween. The ribs extend upwardly from a convex bottom, upon which the candle may rest. A longitudinal opening through the peripheral wall is disposed adjacent to each rib extending upwardly from the convex bottom. A candle is operatively retained in the candle receiving space by the ribs such that when the candle is lit, the convex bottom ejects melted overflow wax from the candle receiving space through the longitudinal openings.

Another such candle assembly is a votive candleholder in which a generally cylindrical sidewall is divided into opposite compartments by a thermally conductive partition wall. Each compartment has an open end and is sized to hold a votive candle therein disposed on the partition wall. The candleholder is placed on a support surface with one compartment facing upwardly and a votive candle disposed therein, and the other compartment facing the support surface. When the votive candle is burned down, the candleholder is flipped over and a second votive candle is disposed in the other compartment. As the second votive candle burns, the thermally conductive partition wall is heated and melts any remaining wax from the first votive candle, which then drips downwardly onto the support surface.

Yet another such candle assembly is a pillar candle candleholder having four pins extending upwardly from a dished support. A metallic plate, dish-shaped complementary to the support, is disposed on the support. The pins extend upwardly through four holes centrally disposed in the plate. A metallic wick clip is manually urged into a bottom of a candle with a pair of opposing flanges disposed on opposite sides of a wick in the candle. The bottom of the candle is manually urged onto the four pins, which extend through four complementary holes in the wick clip into the candle to hold the candle in an upright position.

SUMMARY OF THE INVENTION

According to one aspect of the invention a fuel element adapted for use with a melting plate candle assembly including a melting plate having a capillary lobe and a locating protrusion extending therefrom includes a fuel charge comprising meltable fuel material and a locating recess disposed in a bottom portion of an outer surface of the fuel charge. The fuel element is adapted to have an operative position on the melting plate, in which a capillary space is formed between the fuel charge and the capillary lobe when the locating protrusion is disposed in the locating recess, and in which the capillary space is adapted to transfer liquid from the melting plate to a wick disposed above the capillary lobe.

According to another aspect of the invention a melting plate candle assembly includes a melting plate having a capillary lobe and a raised locating protrusion adjacent to the capillary lobe and a fuel element operatively engaging the locating protrusion in a pre-defined orientation. A capillary space is disposed between the fuel element and the capillary lobe. The capillary space is adapted to transfer liquid from the melting plate to a wick disposed above the capillary lobe.

According to yet another aspect of the invention a melting plate for a melting plate candle assembly includes a dished heat transmissive plate, a capillary lobe disposed medially in the plate, and a locating protrusion disposed in the plate proximate the capillary lobe. The fuel element has an operative position on the melting plate that forms a capillary space with the capillary lobe when the locating protrusion engages the fuel element in a predefined orientation.

Other aspects of the present invention will become apparent upon consideration of the following detailed description.

DETAILED DESCRIPTION

Figure 1:
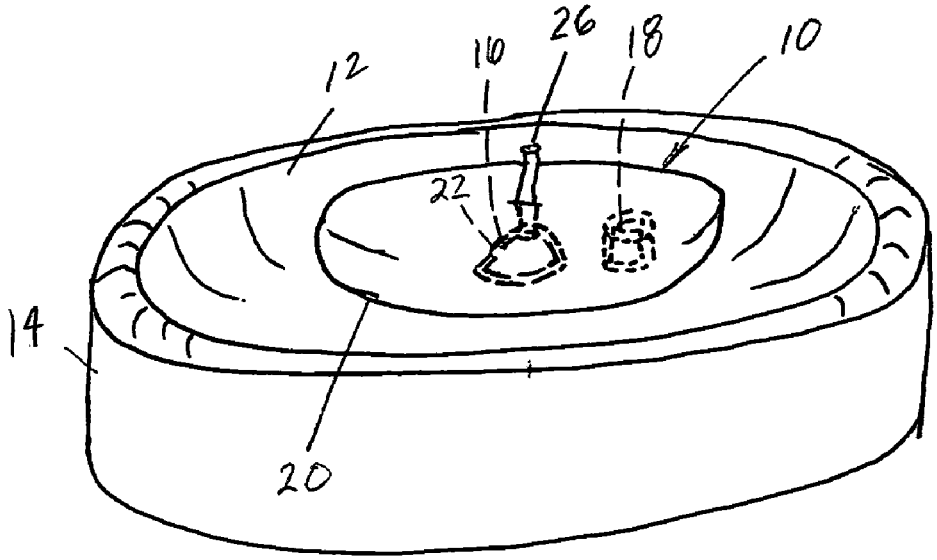
FIG. 1 is an isometric view of a melting plate candle assembly in an operative position according to an embodiment of the invention.
Figure 2:
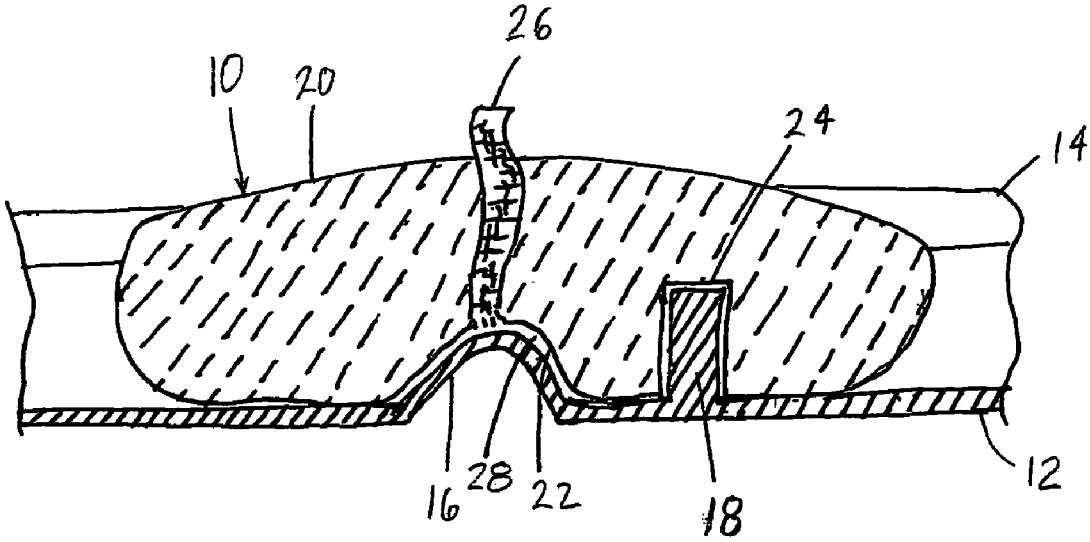
FIG. 2 is a partial cross-sectional view of the melting plate candle assembly shown in FIG. 1.

Turning now to FIGS. 1 and 2, a melting plate assembly includes a fuel element 10 and a melting plate 12 supported by a base member 14. The base member 14 may take any desired form suitable for supporting the melting plate 12, and in one embodiment is formed of a non-heat transmissive material, such as glass, plastic, or ceramic. The melting plate 12 is a dish-shaped member formed of a heat transmissive material, such as aluminum, and includes a capillary lobe 16 centrally disposed therein and a locating protrusion 18 adjacent the capillary lobe. The locating protrusion 18 operatively engages the fuel element 10 in one or more predefined orientations when the fuel element is in a operative position on the melting plate 12. The fuel element 10 includes a meltable fuel charge 20, such as candle wax, a capillary recess 22 and a locating recess 24 disposed in a bottom surface of the fuel charge, and a wick 26 extending between the capillary recess and a top surface of the fuel element. The capillary recess 22 is complementary to the capillary lobe 16 and the locating recess 24 is complementary to the locating protrusion 18. In the operative position shown in the drawings, the bottom surface of the fuel charge 20 is disposed directly on the melting plate 12 when the capillary lobe 16 is disposed within the capillary recess 22 and the locating protrusion 18 is disposed within the locating recess 24. A capillary space 28 extending between the melting plate 12 and the wick 26 is defined between the capillary lobe 16 and the capillary recess 22. In operation, heat from a flame (not shown) on the wick 26 melts the fuel charge 20 by both direct convection and conduction through the melting plate 12 to form a pool of liquid fuel, such as melted candle wax, adjacent to the capillary lobe 16. The liquid fuel is drawn up the capillary space 28 by capillary action to the wick 26 to feed the flame with liquid fuel. A wick clip (not shown) may be used to maintain the wick 26 in an operative position after the fuel charge 20 has been substantially melted. In one embodiment, a volatile active, such as a fragrance or insect repellant, for example, is carried by the fuel element 10 for dispersion to the surrounding environment when the fuel element is burned. Additional details and aspects of a melting plate candle assembly are described in U.S. patent application Ser. No. 11/123,372, which is incorporated herein by reference in the entirety thereof. The locating protrusion 18 facilitates proper placement of the fuel element 10 on the melting plate 12 in the operative position by providing proper alignment of the fuel element with the capillary lobe 16 in the operative position. The locating protrusion 18 may take any form sufficient to facilitate proper alignment of the fuel element 10 in the operative position. In the depicted embodiment, the locating protrusion 18 is a raised button; other exemplary forms may include one or more ridges, buttons, edges, and/or other forms of protrusions. A retention mechanism 68 helps secure the wick holder 52 in the oerative position on the melting plate 40. The retention mechanism in one embodiment includes a magnet disposed under the capillary lobe 42, which magnetically engages ferro-magnetic portions of the wick holder 52 to retain the wick holder on the melting plate 40. Other retention mechanisms may be used in other embodiments, such as, for example, clips, interlocking members, screw threads, interference fit members, adhesive, and other mechanisms capable of operatively retaining the wick holder 52 on the capillary lobe 42.

Figure 3:
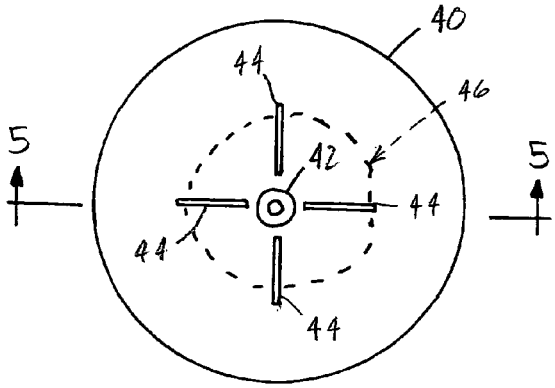
FIG. 3 is a plan view of a melting plate according to another embodiment of the invention.
Figure 4:
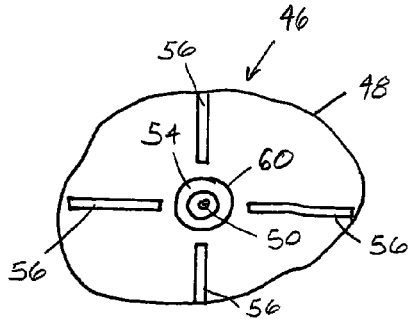
FIG. 4 is a bottom plan view of a fuel element for use with the melting plate shown in FIG. 3.
Figure 5:
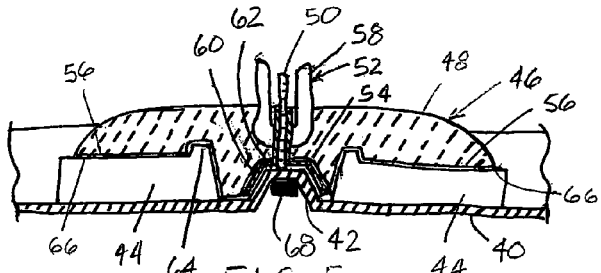
FIG. 5 is a partial cross-sectional view of the melting plate of FIG. 3 and the fuel element of FIG. 4 in an operative position as seen generally along the lines 5-5 of FIG. 3.

In FIGS. 3-5, another melting plate candle assembly according to the present invention includes a melting plate 40 having a capillary lobe 42 and locating protrusions 44 and a fuel element 46 having a fuel charge 48, wick 50, wick holder 52, capillary recess 54, and locating recesses 56. The wick holder 52 includes heat conductive elements, such as heat fins 58, and a capillary skirt 60. The heat fins 58 extend through a portion of the fuel charge 48 from near a flame location on the wick 50. The capillary skirt 60 is disposed within the capillary recess 54 and fits closely about the capillary lobe 42 to form a capillary space 62 therebetween. The wick clip 52 is made of heat transmissive material, such as a metal, which facilitates conductive transfer of heat from the flame to the melting plate 40 and generally decreases melt time for the fuel charge 48. In this embodiment, the locating protrusions 44 are in the form of raised ribs extending radially outwardly from the capillary pedestal 42. The ribs are spaced from the capillary pedestal 42, which permits free flow of liquid fuel around the capillary pedestal and placement of the wick clip 52 over the capillary pedestal. The ribs further include secondary shaped portions, such as raised nibs 64. The locating recesses 56 in one embodiment are grooves in a bottom portion of an exterior surface of the fuel charge 48 that are complementary to the ribs. In one or more predetermined operative positions, the bottom surface of the fuel charge 48 rests directly on the melting plate 40 and the capillary space 62 is formed between the capillary skirt 60 and the capillary lobe 42. The ribs may terminate inside an outer periphery of the fuel element 46, or the ribs may extend beyond the outer periphery thereof. In one embodiment, the ribs have a tapered upper edge 66 to facilitate placing the fuel element 46 thereon, and the upper edge is taller than the capillary pedestal 62.

Figure 6:
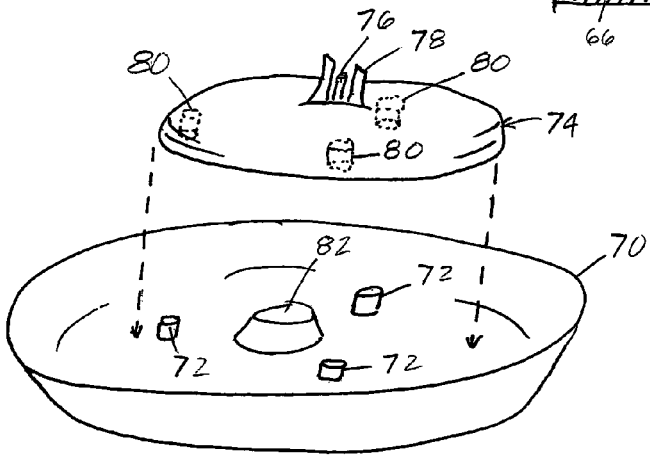
FIG. 6 is a partly exploded isometric view of a melting plate candle assembly according to a further embodiment of the invention.

In FIG. 6, another embodiment of a melting plate candle assembly according to the present invention provides a melting plate 70, which is similar to the melting plate candle assembly shown in FIG. 1, but includes a plurality of circumferentially spaced locating protrusions 72, such as buttons, disposed within an outer periphery of a fuel element 74. The fuel element 74 includes a wick 76 carried by a wick holder 78 and a plurality of locating recesses 80 complementary to the locating protrusions 72. The locating protrusions 72 provide positive indication to a user that the fuel element 74 has been placed in a proper operating position over a capillary lobe 82 on the melting plate 70 when all the locating protrusions are disposed within the locating recesses 80 in a similar manner as described previously herein.

Figure 7:
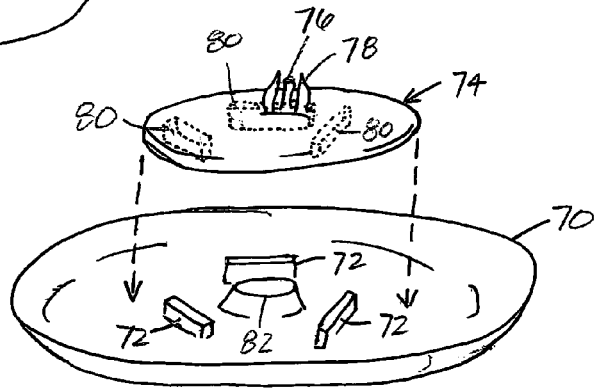
FIG. 7 is a partly exploded isometric view of a melting plate candle assembly according to yet another embodiment of the invention.

In FIG. 7, yet another embodiment of a melting plate candle assembly according to the present invention is similar to the melting plate assembly shown in FIG. 6, except that the location protrusions 72 are in the form of circumferentially spaced ribs and the locating recesses 80 are in the form of grooves complementary to the ribs.

Figure 8:
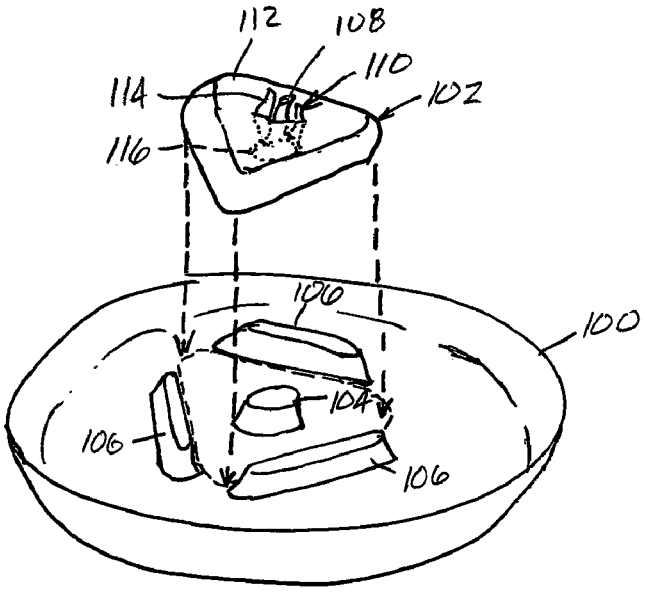
FIG. 8 is a partly exploded isometric view of a melting plate assembly according to a still further embodiment of the invention.
Figure 9:
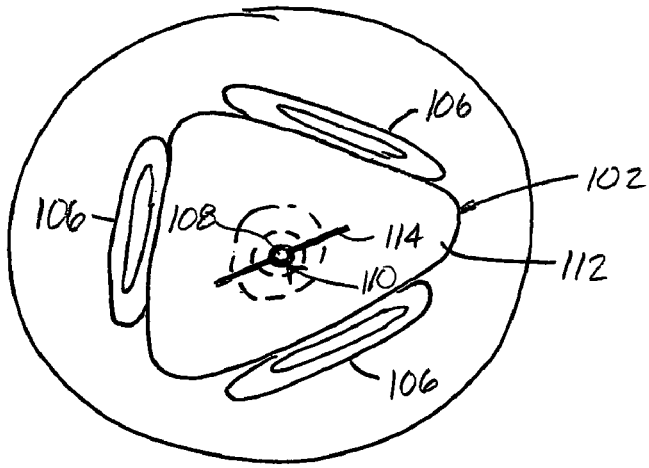
FIG. 9 is a plan view of the melting plate assembly shown in FIG. 8 in an operative position.

In FIGS. 8 and 9, a further embodiment of the present invention includes a melting plate 100 and a fuel element 102, wherein the melting plate includes a capillary pedestal 104 disposed between locating protrusions 106 that define at least a portion of an outer periphery (shown in dashed lines in FIG. 8) of the fuel element. The fuel element 102 includes a wick 108 carried by a wick holder 110 surrounded by a fuel charge 112. The wick holder includes heat fins 114 and a capillary skirt 116 that defines a capillary recess (not shown) in a bottom surface of the fuel charge 112 in a similar manner as described previously herein. In an operative position, the bottom surface of the fuel charge 112 rests directly on the melting plate 100 and a capillary space (not shown) extending from the melting plate upwardly toward the wick 108 is formed between the capillary pedestal 104 and the capillary skirt 116. The fuel element 102 fits between the locating protrusions 106 in a predetermined position relative to the melting plate 100. The fuel element 102 has an asymmetrical outer periphery, which causes the fuel element to have only a single operative position as guided by the locating protrusions 106. In other embodiments, the fuel element 102 may have other shapes and the locating protrusions 106 may be arranged partially or completely therearound so as to provide a plurality of operative positions.

INDUSTRIAL APPLICABILITY

The present invention provides a user with positive indication when a fuel element is operatively disposed on a melting plate so that a capillary space extends from the melting plate to a wick in the fuel element and the fuel element is positioned on the melting plate to provide optimal conductive melting action to the fuel charge. Such positive indication may help the user properly assemble a melting plate candle assembly in an optimal operative position so as to maximize the operative features of the melting plate candle assembly in operation.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications within the scope of the impending claims are reserved.

We claim:

1. A fuel element adapted for use with a melting plate candle assembly, the candle assembly including a melting plate having a capillary lobe and a plurality of ribs, wherein the ribs extend radially from the capillary lobe and at least one rib comprises a raised secondary shaped portion having a height taller than other portions of the rib, the fuel element comprising:

a fuel charge comprising a meltable fuel material;

a capillary recess disposed in an outer surface of the fuel charge, the capillary recess adapted to receive the capillary lobe in the operative position;

a wick carried by a wick holder, the wick being disposed in the fuel charge and in fluid communication with the capillary recess so as to be disposed above the capillary lobe in the operative position; and a plurality of locating recesses disposed in a bottom portion of an outer surface of the fuel charge, wherein the locating recesses are complementary to the ribs and the raised secondary shaped portion;

wherein the fuel element is adapted to have an operative position on the melting place, in which a capillary space is formed between the fuel charge and the capillary lobe when the ribs are disposed in the locating recesses and airflow is substantially blocked between the capillary recess and at least one of the plurality of locating recesses, the capillary space adapted to transfer liquid from the melting plate to a wick disposed above the capillary lobe.

2. The fuel element of claim 1, wherein the wick holder further comprises a heat fin disposed at least partially in the fuel charge and a capillary skirt disposed in the capillary recess, the capillary skirt adapted to form the capillary space in the operative position.

3. The fuel clement of claim 1, wherein the bottom portion of the fuel charge is adapted to contact a portion of the melting plate surrounding the capillary lobe in the operative position.

4. The fuel element of claim 1, wherein the fuel charge comprises candle wax and a volatile active.

5. The fuel element of claim 1, wherein the plurality of locating recesses comprises a plurality of grooves adapted to receive in the operative position the complementary plurality of ribs defined in the melting plate.

6. A fuel element adapted for use with a melting plate candle assembly, the fuel element comprising:

a fuel charge comprising a meltable fuel material;

an exterior surface of the fuel charge having a top surface and a bottom surface;

a centrally located primary cavity disposed in the bottom surface of the fuel charge, the primary cavity extending through the fuel charge and adapted to receive a wick holder; and a plurality of secondary cavities located adjacent the primary cavity and extending radially outwardly, wherein at least one of the plurality of secondary cavities comprises a first height dimension and a second height dimension greater than zero, wherein the first height dimension is different from the second height dimension, and wherein the first and second height dimensions extend at most part way through the fuel charge.

7. The fuel element of claim 6, wherein the first height dimension comprises a distance between the top surface of the fuel charge and an intermediate wall.

8. The fuel element of claim 6, wherein the plurality of secondary cavities are complementary to ribs located adjacent a capillary pedestal.

9. The fuel element of claim 8, wherein the first height dimension is sized to be complementary to raised nibs located on the ribs.

10. The fuel element of claim 9, wherein the second height dimension is sized to correspond to a tapered upper edge of the ribs.

11. The fuel element of claim 10, wherein the secondary cavities extend radially with respect to the primary cavity.

12. A fuel element adapted for use with a melting plate candle assembly having a capillary pedestal and raised locating ribs, the fuel element comprising:

a fuel charge having a meltable fuel material;

an exterior surface of the fuel charge having a top surface and a bottom surface;

a centrally located primary cavity disposed in the bottom surface of the fuel charge adapted to receive a wick holder and the capillary pedestal; and a plurality of straight grooves located adjacent the primary cavity for receiving the locating ribs, wherein the straight grooves extend radially and are spaced from the centrally located primary cavity such that the grooves are not in fluid communication with the primary cavity.

13. The fuel element of claim 12, wherein the straight grooves comprise a top wall that extends from an interior portion of the fuel charge toward the exterior surface of the fuel charge and wherein the top wall of at least one of the plurality of grooves comprises a depression, wherein the depression is adapted to be complementary in shape to a raised portion on the ribs.

14. The fuel element of claim 12, wherein the plurality of straight grooves comprises at least two grooves that extend at an approximate right angle with respect to each other.

15. The fuel element of claim 12, wherein the top wall of the plurality of straight grooves is sloped to correspond to a tapered upper edge of the ribs.

* * * * *

UNITED STATES PATENT AND TRADEMARK OFFICE

CERTIFICATE OF CORRECTION

PATENT NO. : 7,654,822 B2
APPLICATION NO. : 11/182689
DATED : February 2, 2010
INVENTOR(S) : Douglas A. Soller, Nathan R. Westphal and Paul E. Furner It is certified that error appears in the above-identified patent and that said Letters Patent is hereby corrected as shown below:

Title Pg, Item (75) Inventors: Add --Paul E. Furner, Racine, WI (US)--

Column 5, Line 44: replace "place" with --plate--

Column 6, Line 13: replace "cavity" with --cavity,--

Signed and Sealed this

Twenty-seventh Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,654,822 B2
APPLICATION NO. : 11/182689
DATED : February 2, 2010
INVENTOR(S) : Soller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 584 days.

Signed and Sealed this

Twenty-third Day of November, 2010

David J. Kappos

David J. Kappos
*Director of the United States Patent and Trademark Office*